United States Patent [19]

Stiling

[11] 4,176,972

[45] Dec. 4, 1979

[54] COAXIAL PUMP MIXER

[75] Inventor: Rodney A. Stiling, Snyder, N.Y.

[73] Assignee: National Gypsum Company, Dallas, Tex.

[21] Appl. No.: 932,302

[22] Filed: Aug. 9, 1978

[51] Int. Cl.[2] ..... B01F 7/26

[52] U.S. Cl. ..... 366/304; 366/306; 366/317

[58] Field of Search ..... 366/263-265, 366/302-304, 306, 317; 156/39, 346

[56] References Cited

U.S. PATENT DOCUMENTS

| | | | |
|---|---|---|---|
| 2,641,453 | 6/1953 | Teale | 366/303 X |
| 3,231,242 | 1/1966 | Schrier | 366/304 |
| 3,459,620 | 8/1969 | McCleary et al. | 366/303 |

*Primary Examiner*—Edward L. Roberts
*Attorney, Agent, or Firm*—Robert F. Hause

[57] ABSTRACT

A thin, circular mixing apparatus for receiving from separate sources (1) dry calcined gypsum powder and (2) the liquid ingredients of the core of a gypsum wallboard, with the liquids being fed to a small diameter radially inward centrifugal pump portion, the dry ingredients being fed to a medium diameter circular portion into which the centrifugal pump elements continually force the liquids in an outwardly spiralling path and having a radially outermost circular portion into which the mixture is further forced in a continued outwardly spiralling path and out from which the mixture is discharged, between rotating radially outwardly projecting teeth.

9 Claims, 6 Drawing Figures

Fig. 1
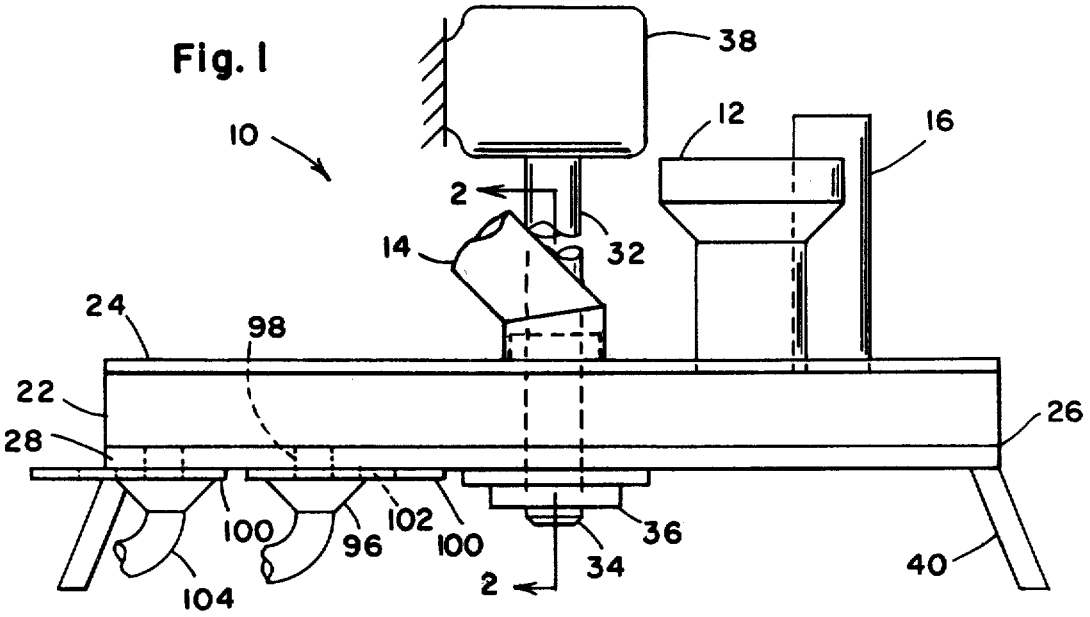
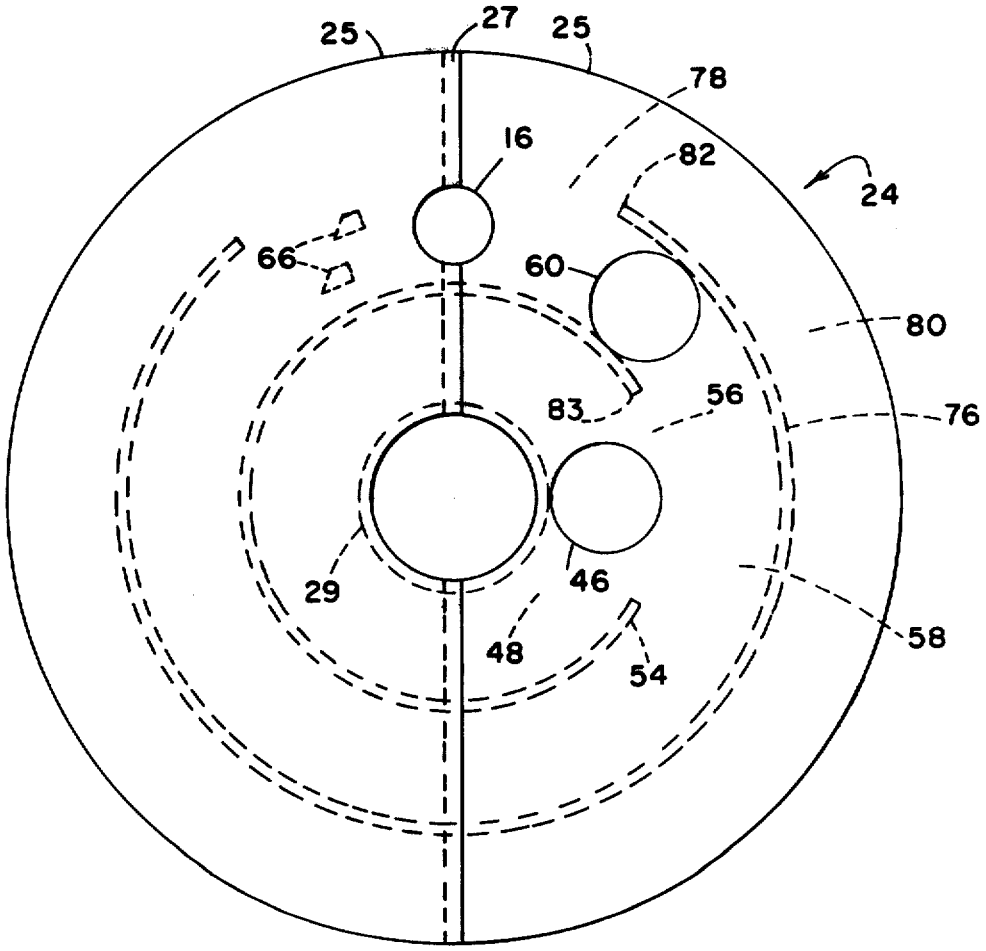
Fig. 4

COAXIAL PUMP MIXER

This invention relates to a gypsum slurry mixer of the type intended for mixing together the ingredients of an aqueous gypsum slurry, such as is used in forming the gypsum core of paper-covered gypsum wallboard. The mixing of these slurries requires that the ingredients be completely and uniformly intermixed with as little excess mixing action as possible in order to avoid destroying the weight lowering foam ingredient in the mixture.

The prior common mixer for gypsum slurries for gypsum wallboard is a thin, circular pin mixer, which is similar in some respects to the mixer of the present invention. Both mixers have a plurality of inlet pipes in the top of a stationary casing, a rotatably mounted rotor disk within the casing, an outlet at the outer periphery, and means for rotating the rotor disk. In both mixers, the ingredients to be mixed are deposited through the inlet pipes onto the upper surface of the rotor disk and they move radially outwardly on the rotating disk, because of centrifugal forces, to the outer periphery whereat the mixture is discharged.

In the prior mixers, the radially outwardly moving ingredients within the mixer were prevented from forming into large clumps by a plurality of pins of small circular cross-section, some of which were affixed to the top of the casing extending downwardly to close to the rotor disk surface, and others which were affixed to the rotor disk extending upwardly to close to the top of the casing, disposed to intermesh with each other, as shown in U.S. Pat. No. 3,459,620.

Although these prior mixers are commonly referred to as pin mixers, it has been determined that the intermeshing pins do very little mixing, and that substantially all of the mixing occurs as the ingredients pass through a series of rapidly rotating teeth disposed on the outer periphery of the rotor disk.

The present invention has eliminated the pins from the mixer and replaced them with angled deflecting vanes and, of even greater significance, added a plurality of centrifugal pump elements to the radially inner portion of the rotor disk whereat the liquid ingredients are introduced. The centrifugal pump elements and the deflecting vanes do contribute very substantially to the essential mixing of the ingredients whereby the efficiency of the pump mixer is substantially greater than that of a pin mixer of equal size. Thus, substantially smaller and more economical pump mixers can replace a larger pin mixer.

Still further, the pump mixer has been formed to decrease very markedly the amount of accumulation of small clumps of material, in relatively dead spots within the mixer, whereby operation of the pump mixer can be continued without shutdown for clean-out, for several times as long as the between clean-out period for the pin mixer.

It is, therefore, an object of the present invention to provide a novel apparatus for mixing the ingredients which form a gypsum wallboard core.

It is a further object of the invention to provide a slurry mixer having improved efficiency of mixing action and greater periods of operation between necessary clean-outs of accumulated material therein.

It is a still further object to provide a method of mixing a liquid and solid gypsum core slurry more efficiently than heretofore.

These and other objects and advantages will become more readily apparent when considered in relation to the preferred embodiment as set forth in the specification and shown in the drawings in which:

FIG. 1 is an elevational view, taken from a front corner, of the pump mixer of the invention.

FIG. 4 is a plan view of the top cover of the pump mixer of FIG. 1.

Figure 2:
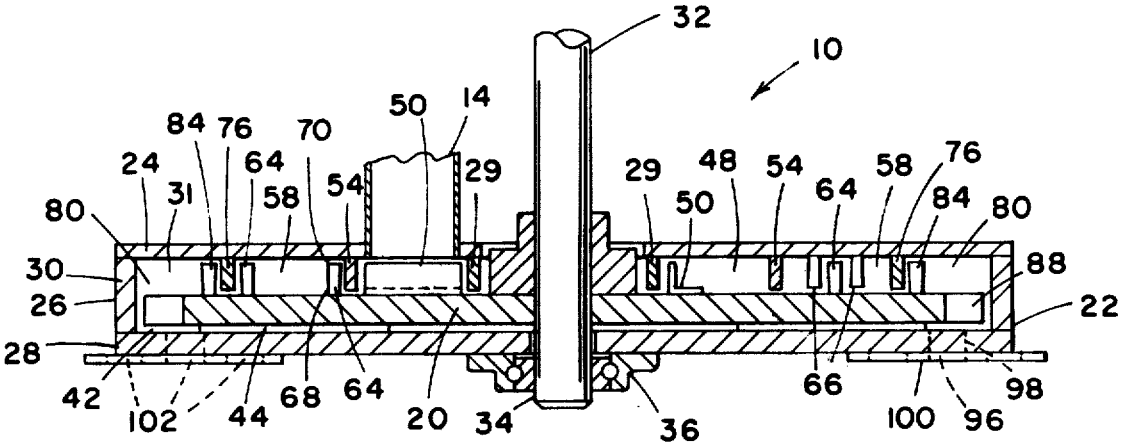
FIG. 2 is an elevational cross-section of the pump mixer of FIG. 1 taken on line 2—2 of FIG. 1.
Figure 3:
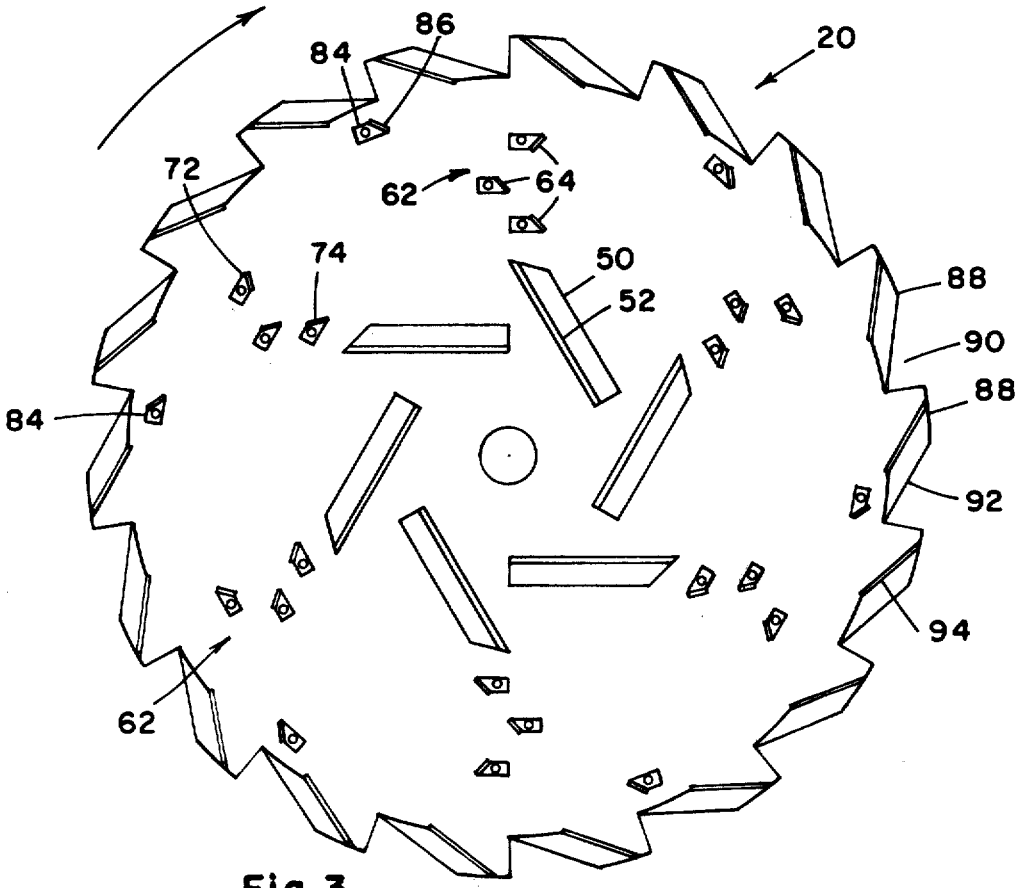
FIG. 3 is a plan of the rotor disk of the pump mixer of FIG. 1.
Figure 5:
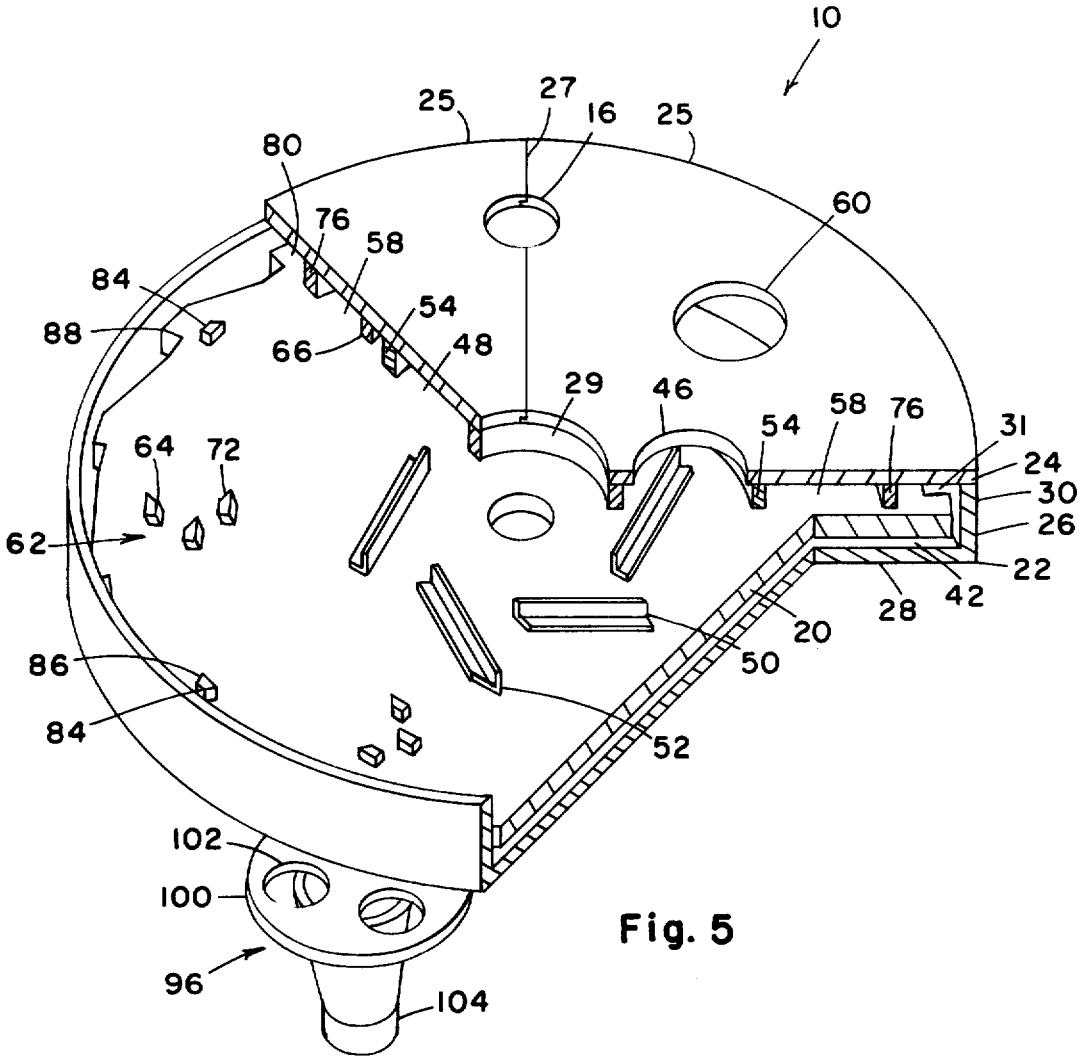
FIG. 5 is an isometric view of a portion of the pump mixer of FIG. 1 with portions broken away.

Referring to the drawings, there is shown a pump mixer 10 having a feed hopper 12 for feeding in calcined gypsum and liquid feed conduit 14 for feeding in the liquid components of a slurry to be used in forming the core of a gypsum wallboard. A vent 16 permits the escape of air that becomes entrapped in the mixer. Vent 16 is a pipe which extends high enough so that slurry is prevented from escaping out the vent.

A rotatably mounted substantially flat circular rotor disk 20 is mounted within a fixed housing 22, providing the primary elements of pump mixer 10.

Housing 22 consists of a flat circular top wall 24 and a lower section 26 which includes a circular bottom 28, a radially inwardly disposed annular wall 29, and a radially outwardly disposed annular wall 30. A thin, hollow circular chamber 31 is formed within housing 22 with rotor disk 20 disposed at the bottom of the chamber 31. Top wall 24 is preferably formed for convenience in two opposed sections 25, 25 with overlapping stepped edges 27 at the juncture.

A rotatable vertical shaft 32 on which disk 20 is mounted, extends vertically through housing 22 with a bottom end 34 supported on bearings 36 located in a downwardly projecting central portion of bottom 28. The upper portion of shaft 32 is connected to suitable rotary drive means, such as motor 38.

The pump mixer 10 is supported upon feet 40 affixed to bottom 28.

The rotor disk 20 is mounted on shaft 32 so that only a very slight space 42 is provided between the underside of rotor disk 20 and the housing bottom 28. Preferably, a small bottom scraper 44 extends downwardly within space 42, arranged to remove material which inadvertently gets into space 42.

Liquid feed conduit 14 extends to an opening 46 through top wall 24. Opening 46 is located over a radially innermost first circular zone 48 of rotor disk 20. Mounted atop the first circular zone 48 are six centrifugal pump impellers 50, located uniformly around zone 48. Impellers 50 are short lengths of angle iron having an upstanding leg 52 which extends upward to closely adjacent the top wall 24.

Impellers 50 are disposed at an acute angle to a tangent to the circle of first circular zone 48, in a direction which will propel liquid radially outward when disk 20 is rotated clockwise.

At the radially outer edge of first zone 48, a stationary first circular wall 54 extends downward from top wall 24, and extends throughout an arc of 300°, leaving an opening 56, through which liquid can be propelled from first zone 48 into a second circular zone 58.

Feed hopper 12 has an outlet at opening 60 in top wall 24. Opening 60 is located over second circular zone 58 of rotor disk 20. Mounted atop the second circular zone 58 are six groups 62 of three deflectors 64 each. The six groups 62 are evenly spaced around the circle of second zone 58. The three deflectors 64 in each group are placed in spaced apart, substantially side-by-side progressively radially outward positions.

Two similar deflectors 66 are mounted on the top wall 24, located so that one will be radially between the inner two of the deflectors 64 of each group 62 and the other will be radially between the outer two of the deflectors 64 of each group 62, as deflectors 62 are rotated with the rotation of rotor disk 20.

Figure 6:
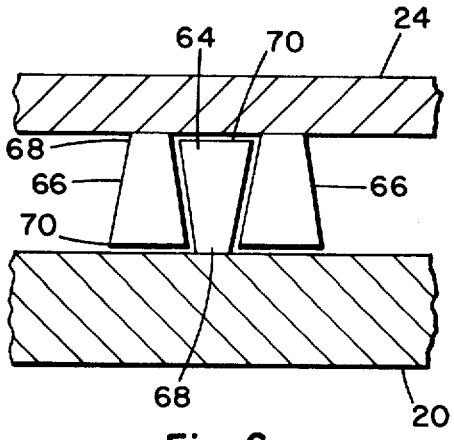
FIG. 6 is an enlarged view of the second zone deflectors of FIG. 2.

In the preferred form, deflectors 64 and the deflectors 66 are all narrower, in a radial direction, at the respective base 68 of each than at the outermost end 70 of each, as most clearly shown in FIG. 6.

Deflectors 64 and deflectors 66 have leading edges 72 which are at an acute angle to the direction of relative movement therebetween, with special wearing surface plates 74 affixed over the leading edges. The leading edges of deflectors 66 and of the inner two rows of deflectors 64 are angled to urge material radially outwardly, and the leading edges of deflectors 64 in the outer row are angled to urge material radially inwardly.

At the radially outer edge of second zone 58, a stationary second circular wall 76 extends downward from top wall 24, and extends throughout an arc of 290°, leaving an opening 78, through which liquid and solid can be propelled from second zone 58 into a third zone 80. Opening 78 is disposed with a clockwise-most terminus 82 located radially outward from near the counterclockwise-most terminus 83 of opening 56 of first wall 54.

In a radially inner portion of third zone 80, there are six deflectors 84, similar to deflectors 64 mounted on rotor disk 20 in equal spaced dispositions around the circle of third zone 80, and with angled leading edges 86 to urge material radially outward when rotor disk 20 is rotated clockwise.

In a radially outer portion of third zone 80, the rotor disk is formed with a plurality of radially outwardly extending, spaced apart large teeth 88. Teeth 88 are formed by passages 90, between teeth 88, being cut out of the outer periphery of rotor disk 20. Teeth 88 are formed with a leading edge 92, when rotated clockwise, which is at acute angle which will urge material upward. Stainless steel wear plates 94, on leading edges 92, resist wear and permit replacement when worn out.

Three mixer outlets 96 each consist of a hole 98 through the bottom 28, underneath the teeth portion of rotor disk 20, and a control plate 100 beneath each hole 98. The control plate 100 has three holes 102, and is rotatable so that any one of the three holes 102 can be aligned with its hole 98. By a slight rotation of plate 100, a hole 102 can be placed slightly out of alignment with hole 98, in order to control the rate at which mixed liquid and solid slurry comes out of each outlet 96. The three holes 102 in plate 100 are provided so that a new hole 102 can be used when a previously used one becomes too worn away.

Below each plate 100 is a reinforced rubber tubing 104, each of which directs mixed slurry to one-third of the width of a wallboard-producing machine.

In a preferred form of the invention, the pump mixer 10 has a diameter of about four feet, shaft 32 has a diameter of about three inches, first wall 54 has a diameter of about two feet, second wall 76 has a diameter of about three feet and chamber 31 has a height of about two inches from the top of rotor disk 20 to the bottom of top wall 24.

The impellers 50 are, preferably, about nine inch long pieces of angle iron, having an innermost end tangent to an innermost portion of rotor disk 20. Rotor disk 20 is between about one and two inches thick, particularly at the outer periphery, whereby the solids and liquids must pass through a one to two inch long passage between any two of the teeth 88, which are angled to urge material back away from the outlet 96, creating a very great but very brief thorough mixing of the solids and liquids.

With the rotor disk 20 rotating at about 300 RPM, a suitable liquid-solid slurry can be uniformly mixed at a rate of about 900 pounds of solid and 750 pounds of liquid per minute, consisting primarily of finely ground calcined gypsum solids and foamed water liquid.

Having completed a detailed disclosure of the preferred embodiments of my invention so that those skilled in the art may practice the same, I contemplate that variations may be made without departing from the essence of the invention.

I claim:

1. A mixer comprising a rotatably mounted substantially flat circular rotor disk, a fixed housing disposed over said rotor disk having a top wall and a radially outwardly disposed annular wall, said rotor disk, said top wall and said annular wall forming a thin, circular hollow chamber within which ingredients to be mixed are centrifugally propelled radially outward, a liquid inlet opening in said top wall disposed above a radially innermost first circular zone of said rotor disk, a solids inlet opening in said top wall disposed above a second circular zone of said rotor disk which is radially outward of said innermost zone, a radially outermost third circular zone of said rotor disk over which solids and liquids must pass in order to exit from said chamber, a plurality of centrifugal pump impeller vanes on said disk in said first circular zone, an outlet for mixed liquids and solids in the radially outer periphery of said housing and a plurality of teeth on said disk outer periphery disposed between said hollow chamber and said outlet, whereby said mixed liquids and solids must pass between the rotating teeth to get to the said outlet.

2. A mixer as defined in claim 1 wherein said first and second zones are separated by a wall which extends a substantial portion of the length of the circular border therebetween.

3. A mixer as defined in claim 1 wherein said second and third zones are separated by a wall which extends a substantial portion of the length of the circular border therebetween.

4. A mixer as defined in claim 2 wherein said second and third zones are separated by a second wall which extends a substantial portion of the length of the circular border therebetween, said two walls each having an opening therethrough, said two openings being not radially aligned one with the other.

5. A mixer as defined in claim 1 wherein a plurality of intermeshing deflectors are mounted on the second zone of said rotor disk and the area of said top wall above said second zone.

6. A mixer as defined in claim 5 wherein said intermeshing deflectors have base portions which are narrower in a radial direction than the deflector outermost portions.

7. The method of mixing a combination of liquid and solid ingredients comprising the steps of continuously depositing a supply of liquid on a rapidly rotating horizontally disposed disk, said disk being disposed within the lower portion of a hollow cylindrical housing having a diameter substantially greater than the vertical axial dimension thereof, and having a material movement space between a top wall of said housing and said rotating disk, depositing said liquid closely adjacent the center of said disk, propelling said liquid radially outwardly with centrifugal pump impeller vanes which are mounted on said disk in a concentric circular first zone on said disk whereat said liquid is deposited, continuously depositing finely ground solids on said disk in a second circular zone radially outward of said liquid deposit zone, propelling both the liquid and solids in said second zone radially outwardly by the centrifugal force of rotating with said disk and by the radially outward movement of the liquid induced by said centrifugal pump vanes, moving said radially outwardly moving liquids and solids through a third radially outermost zone, restricting the exiting of said liquids and solids to passage through stationary exit means in a radially outer portion of said housing which is separated from said material movement space by a plurality of spaced apart teeth on the outer periphery of said disk, whereby said liquids and solids must move through the spaces between said rapidly rotating teeth prior to exiting through said stationary exiting means in said housing.

8. The method of claim 7 wherein said material movement from said first zone to said second zone is restricted by a circular wall extending down from said housing top wall therebetween and extending a major portion of the distance around said first zone, and wherein said material movement from said second zone to said third zone is restricted by a circular wall extending down from said housing top wall therebetween and extending a major portion of the distance around said second zone, and wherein the opening through the outer of said two walls is disposed radially out of line with the opening through the inner of said two walls such that a substantial portion of the liquid exiting from said first zone is directed substantially completely around said second zone.

9. The method of claim 7 wherein material within said second zone is kept from forming large agglomerates by self-cleaning intermeshing deflectors alternately disposed on the rotating disk and on the housing top wall, said deflectors being self-cleaning by being narrower at the portion which is the respective base of each than at the outermost end of each, and being closely spaced to closely intermesh when the deflectors affixed to said rotating disk pass between said deflectors on said housing top wall.

* * * * *